US006922916B1

(12) United States Patent
Potter

(10) Patent No.: US 6,922,916 B1
(45) Date of Patent: Aug. 2, 2005

(54) FOOTWEAR WITH OUTSOLE WEAR INDICATOR

(75) Inventor: Daniel R. Potter, deceased, late of Forest Grove, OR (US); by Janis E. Potter, legal representative, Forest Grove, OR (US)

(73) Assignee: Nike, Inc., Beaverton, OR (US)

( * ) Notice: Subject to any disclaimer, the term of this patent is extended or adjusted under 35 U.S.C. 154(b) by 32 days.

(21) Appl. No.: 10/654,609

(22) Filed: Sep. 4, 2003

(51) Int. Cl.[7] ..... A43B 13/14
(52) U.S. Cl. ..... 36/31; 36/8.4; 36/1
(58) Field of Search ..... 36/25 R, 31, 30 R, 36/39, 42, 61, 8.4, 1

(56) References Cited

U.S. PATENT DOCUMENTS 2,391,564 A * 12/1945 Gregg ..... 36/30 R
2,772,196 A * 11/1956 Pooley ..... 428/187
3,362,376 A * 1/1968 Norton ..... 116/208
3,631,614 A * 1/1972 Rice ..... 36/61
3,929,179 A * 12/1975 Hines ..... 152/154.2
5,406,723 A 4/1995 Okajima
5,433,022 A * 7/1995 Lo et al. ..... 36/30 R
5,572,805 A 11/1996 Giese et al.
5,894,682 A * 4/1999 Broz ..... 36/31
6,119,373 A * 9/2000 Gebhard et al. ..... 36/114
6,158,150 A 12/2000 Morris et al.
6,163,982 A * 12/2000 Ellis, III ..... 36/25 R
6,202,326 B1 * 3/2001 Hauglin ..... 36/117.2
6,278,378 B1 * 8/2001 Feiner et al. ..... 340/815.45
6,425,193 B2 * 7/2002 Vaz ..... 36/30 R
6,625,905 B2 * 9/2003 Kita ..... 36/30 R

* cited by examiner

*Primary Examiner*—M. D. Patterson
(74) *Attorney, Agent, or Firm*—Banner & Witcoff, Ltd.

(57) ABSTRACT

The invention is a wear indicator for a footwear outsole. The wear indicator includes a plurality of strata that each have different properties, such as color. As portions of an individual stratum are worn away, corresponding portions of an underlying stratum are revealed. The underlying strata may be worn away in a similar manner to reveal further strata, thereby providing a wearer with the ability to determine the amount of wear that has occurred in an outsole.

27 Claims, 2 Drawing Sheets

FOOTWEAR WITH OUTSOLE WEAR INDICATOR

BACKGROUND OF THE INVENTION

1. Field of the Invention

The present invention relates to footwear. The invention concerns, more particularly, a footwear outsole with a wear indicator.

2. Description of Background Art

An article of footwear generally includes an upper and a sole structure. The upper comfortably receives a foot and secures the foot to the sole structure. The sole structure provides a durable medium for supporting the foot and may include multiple elements, including a ground-contacting outsole.

The structure of an outsole may be selected from a variety of configurations that are specifically tailored to the intended purpose for which the footwear is designed. An outsole intended for running shoes, for example, may be formed from a durable synthetic material, such as rubber, that resists wear during use and may include a textured surface to enhance traction. An outsole for a dress shoe, however, may be formed from multiple layers of leather that incorporate rubber elements in high-wear areas. Similarly, an outsole for a skateboarding shoe may include portions that wrap onto the sides of the upper to provide wear resistance in areas that individuals drag along the ground for reducing the velocity of a skateboard. Accordingly, outsoles may have a variety of configurations, depending upon the intended purpose for the footwear.

An outsole forms the ground-contacting portion of an article of footwear and, therefore, may be subjected to high levels of wear. During running, for example, the rear-lateral corner of a running shoe initially contacts the ground and the running shoe then rotates forward such that a majority of the outsole is in contact with the ground. The heel portion of the outsole then disengages from the ground such that only the toe portion remains in contact. Finally, the runner propels forward utilizing only the toe portion of the outsole, a process termed toe-off, and the entire outsole is lifted from the ground to begin another cycle. At each phase of the running cycle where portions of the outsole are in contact with the ground, those portions experience abrasive forces from the ground. That is, portions of the outsole in contact with the ground experience wear that has the potential to eventually wear through the entire outsole in localized, high-wear areas. With regard to running, the high-wear areas may be the rear-lateral corner of the outsole, where initial contact with the ground occurs, and the toe portion of the outsole, where toe-off occurs.

Dress shoes and skateboarding footwear may also experience unique wear patterns that are dependent upon the manner in which the outsoles contact the ground. Like running shoes, dress shoes may experience high levels of wear in the heel and toe regions due to similarities in the running and walking cycles. Skateboarding shoes, however, generally experiences wear patterns that are distinct from the wear patterns associated with running and dress shoes. Although skateboarding shoes are utilized for walking and running, which may develop the wear patterns discussed above, the primary wear areas include portions of the skateboarding outsole that wrap onto the upper. During skateboarding activities, an individual may drag the skateboarding shoe against the ground in an effort to reduce the velocity of the skateboard. Generally, the toe portion of the skateboarding shoe, particularly the toe portions of the outsole that wrap onto the upper, are utilized for this purpose. Unlike running shoes and walking shoes, where the high-wear areas are concealed on the bottom portion of the footwear, high-wear areas of skateboarding shoes are prominently displayed and may be viewed as symbols of skateboarding prowess, particularly when the high-wear areas are worn in a manner that is severe or distinctive.

Although the degree of wear in outsoles may be viewed as a status symbol, as in skateboarding footwear, high levels of outsole wear may also detract from the utility of footwear. As the outsole wears away in running shoes, the midsole may become exposed. In general, midsole structures are formed from a foam material, such as ethylvinylacetate or polyurethane foam, that has a relatively small degree of wear resistance. High levels of outsole wear in running shoes may, therefore, develop areas in the shoes that permit stones or water to enter through the sole structure. Similar considerations are applicable to dress shoes and skateboarding shoes.

Individuals may usually determine whether an outsole is highly worn by inspecting the outsole visually. With running shoes and skateboarding shoes, the textured, traction-promoting surface may have a smooth aspect that signals high degrees of wear. Alternately, portions of the midsole or upper may be visible through the wear areas. With dress shoes, the leather portions of the sole may develop holes, or the thread that secures the sole structure to the upper may wear through such that the outsole separates from the upper. In general, these methods of determining wear only signal high degrees of wear that require replacement of the footwear or replacement of the sole structure.

SUMMARY OF THE INVENTION

To address these issues, the present invention provides a system by which an individual may determine the degree of wear in an outsole prior to the high levels of wear that signal the functional end of an outsole's useful life. The system includes an outsole for an article of footwear that includes a wear indicator. The wear indicator is formed of a plurality of strata that extend parallel to an exterior surface of the outsole. The strata include a first stratum and a second stratum that are adjacent to each other. The first stratum has a first color and the second stratum has a second color, the first color being visually distinct from the second color.

As the outsole is worn against the ground, for example, layers of the first stratum will wear away. Following sufficient wear, a portion of the first stratum will develop an aperture that exposes a corresponding portion of the second stratum. This provides the wearer with a visual indication regarding the degree of wear in the outsole.

The wear indicator may be structured to have any number of strata. In addition to variations in color between the individual strata or variations in the number of strata, the wear indicator may be structured to have varying wear properties between the individual strata. For example, an exterior stratum may have less wear-resistance than an interior stratum to promote an initial degree of wear in the outsole. Furthermore, the location of the wear indicator may vary. In some articles of footwear, particularly running shoes and dress shoes, the wear indicator may be located in a portion of the sole that lies under the upper. In skateboarding shoes, the wear indicator may be located in portions of the outsole that are on the sides of the upper, in addition to the portion lying under the upper. Alternately, the wear indicator may be solely located in portions on the sides of the upper.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

The following discussion and accompanying figures disclose an article of footwear having an outsole with a wear indicator in accordance with the present invention.

Concepts relevant to the outsole wear indicator will be primarily described and depicted with reference to a skateboarding shoe 100. The concepts disclosed with regard to skateboarding shoe 100, however, are applicable to a variety of footwear styles, including running shoes, other types of athletic shoes, dress shoes, boots, rock climbing shoes, and sandals, for example.

Figure 1:
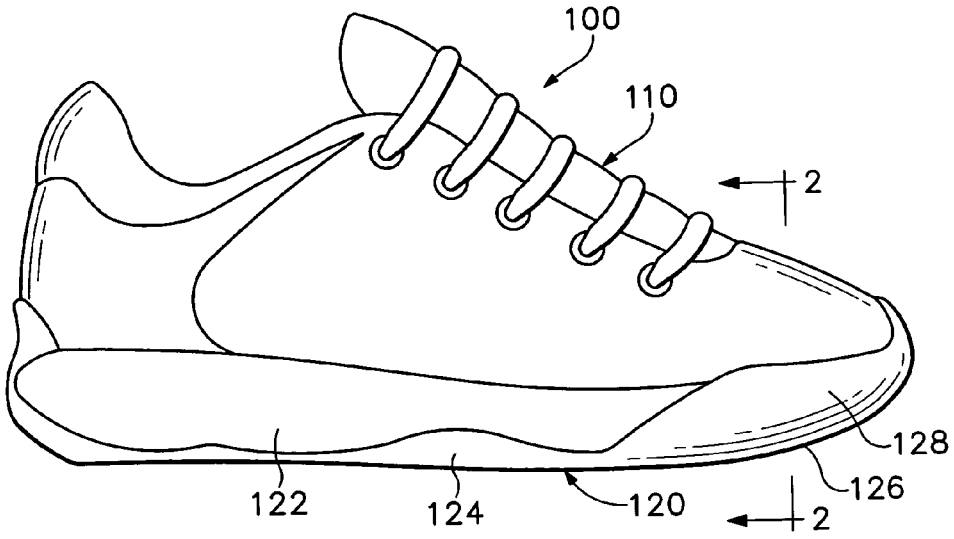
FIG. 1 lateral elevational view of an article of footwear having an outsole with a wear indicator in accordance with the present invention.

Skateboarding shoe 100 is depicted in FIG. 1 and includes an upper 110 and a sole structure 120. Upper 110 may have the structure of a conventional upper for footwear intended for use in skateboarding activities. Sole structure 120 is secured to upper 110 and provides a wear-resistant surface for contacting the ground. The primary elements of sole structure 120 are a midsole 122 and an outsole 124. Midsole 122 may be formed of a polymer foam material, such as polyurethane or ethylvinylacetate, that attenuates ground reaction forces and absorbs energy, thereby providing cushioning. In accordance with conventional skateboarding footwear, outsole 124 includes a lower portion 126 that extends under upper 110 and a toe portion 128 that extends upward and onto sides of a toe region of upper 110.

During skateboarding activities, individuals customarily utilize footwear as a means to reduce the velocity of the skateboard. That is, individuals drag the footwear along the ground to slow the skateboard. In this manner, the footwear experiences significant wear due to the abrasive and frictional forces that act upon the footwear while in contact with the ground. Accordingly, articles of skateboarding footwear conventionally include outsole portions in areas of the footwear that are usually utilized in this manner, particularly on sides of the upper in the toe region. Accordingly, skateboarding shoe 100 has the general appearance and structure of a conventional article of skateboarding footwear. As will be described in the following discussion, however, outsole 124 includes a wear indicator.

When a specific portion of outsole 124, such as toe portion 128, is placed in sliding engagement with the ground, the outer surface of outsole 124 wears away first, thereby exposing a previously unexposed portion of outsole 124. When the same specific portion of outsole 124 is placed in sliding engagement with the ground for a second time, the newly exposed portion of outsole 124 is worn away, thereby exposing another previously unexposed portion of outsole 124. This process may be repeated a multiplicity of times until outsole 124 develops an aperture that exposes a corresponding portion of upper 110. Accordingly, the process of reducing the velocity of a skateboard, which involves dragging skateboarding shoe 100 across the ground, wears away successive layers of outsole 124 until upper 110 is exposed. Foreseeably, successive layers of upper 110 may also be worn away in a similar fashion until a hole develops in footwear 100.

Although the areas of a conventional outsole that are worn away will be apparent to individuals, the degree of wear in each area may not be fully apparent until an aperture develops through the conventional outsole. That is, an individual may not be able to accurately distinguish the areas of a conventional outsole that are mildly worn from areas that are severely worn when a significant portion of the conventional outsole displays some degree of wear. In order to provide individuals with a system for determining the degree of wear in each portion of outsole 124, the present invention incorporates an outsole wear indicator.

Figure 2:
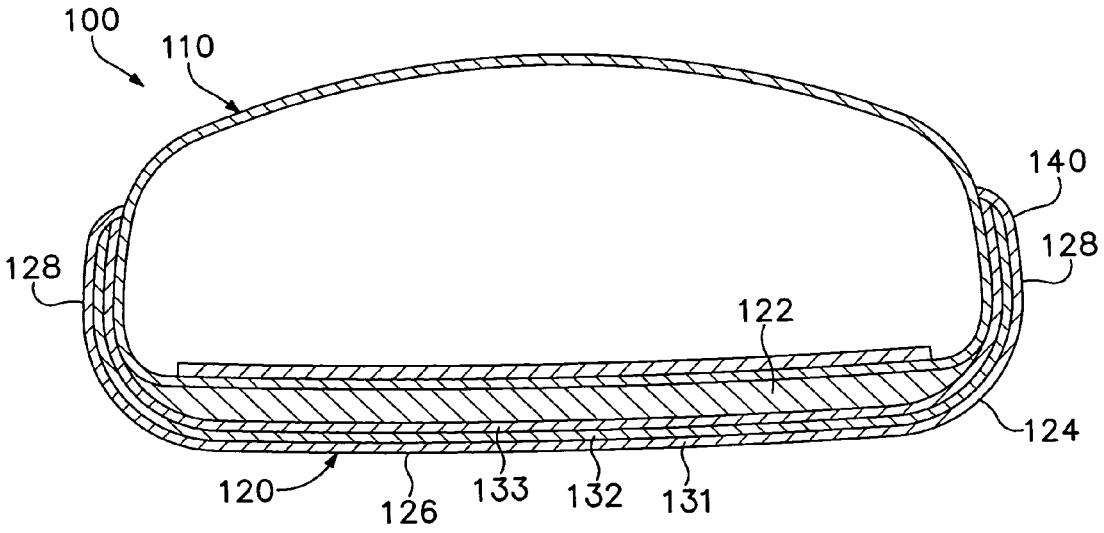
FIG. 2 is a cross-sectional view of the footwear, as defined by line 2—2 in FIG. 1.

The outsole wear indicator of the present invention may have a variety of forms. In one embodiment the outsole wear indicator is a series of differently colored layers that comprise outsole 124. With reference to FIG. 2, a cross section through footwear 100 is depicted, wherein outsole 124 includes three strata 131–133 of outsole material that each have a different color. The colors may be selected such that stratum 131 is green, stratum 132 is yellow, and stratum 133 is red, for example. Alternately, the various colors of strata 131–133 may be different shades of a single color such that stratum 131 is a dark shade of red, stratum 132 is an intermediate shade of red, and stratum 133 is a light shade of red, for example. In addition, the selected colors could match the colors of upper 110, thereby providing an aesthetic coordination between the colors of upper 110 and outsole 124. The specific color combinations selected for strata 131–133 may vary significantly within the scope of the present invention. The specific color combinations should, however, be visibly distinguishable, as will become apparent from the discussion below.

As discussed above, the process of reducing the velocity of a skateboard, which involves dragging skateboarding shoe 100 across the ground, wears away successive layers of outsole 124. In skateboarding footwear that includes a conventional outsole, the various layers are indistinguishable from each other such that an outer outsole layer has the same color as an inner outsole layer. With regard to skateboarding shoe 100, however, strata 131–133 provide an outsole wear indicator that permits individuals to quickly distinguish between portions of outsole 124 that were originally located on the exterior of outsole 124 and portions that were originally located on the interior of outsole 124.

Figure 3A:
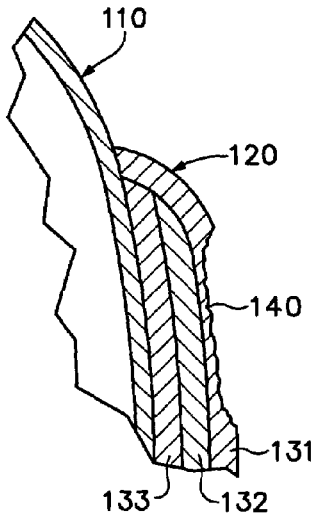
FIG. 3A is a cross-sectional view that corresponds with the cross-section of FIG. 2, wherein a portion of a first stratum is worn away.

The manner in which layers 131–133 of outsole 124 wear away will be described with reference to FIGS. 3A–3C. When outsole 124 is initially placed in sliding engagement with the ground, a relatively small portion of stratum 131 is worn away due to abrasive and frictional forces (see point 140 in FIG. 3A). Assuming that stratum 131 has a green color, the newly exposed portion of outsole 124 will also have a green color as stratum 131 is not worn entirely through. Following a small amount of use, therefore, the individual will see only a green color in outsole 124, thereby indicating that outsole 124 is only mildly worn.

Figure 3B:
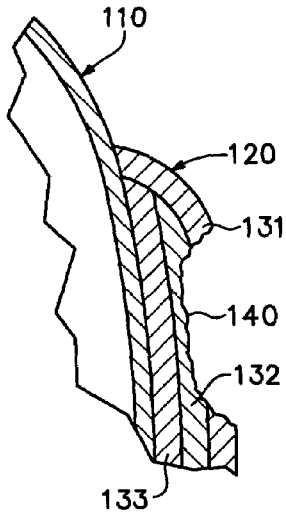
FIG. 3B is a cross-sectional view that corresponds with the cross-section of FIG. 2, wherein a portion of a second stratum is exposed.

The process of utilizing skateboarding shoe 100 to slow the velocity of a skateboard may be repeated a multiplicity of times until successive layers of stratum 131 are worn away in the area of engagement with the ground and stratum 132 is exposed (see point 140 in FIG. 3B). At this point, an inspection of outsole 124 will reveal that a portion of stratum 132 is visible. Assuming that stratum 132 is yellow, the newly exposed portion of outsole 124 will have a yellow color. Following an intermediate usage of skateboarding shoe 100, therefore, the individual will see a yellow color in portions of outsole 124, thereby indicating that outsole 124 is worn to an intermediate degree.

Figure 3C:
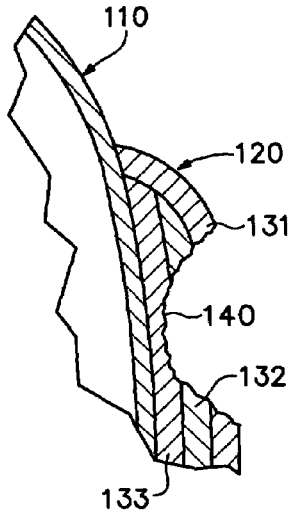
FIG. 3C is a cross-sectional view that corresponds with the cross-section of FIG. 2, wherein a portion of a third stratum is exposed.

The process of wearing away successive layers of outsole 124 may be repeated further until a portion of stratum 132 is worn away and stratum 133 is exposed (see point 140 in FIG. 3C). Assuming that stratum 133 is red, the newly exposed portion of outsole 124 will have a red color. After significant use, therefore, a red color will be visible in outsole 124, thereby indicating that stratum 133 is exposed. Accordingly, the various colors of strata 131–133 provide a system that indicates the degree to which specific portions of outsole 124 are worm. Like a traffic signal, wherein green indicates go, yellow indicates that one should proceed with caution, and red indicates the presence of danger, the various layers 131–133 may be utilized to indicate the relative propriety of continued wear in a specific area of outsole 124. Furthermore, literature may be provided with skateboarding shoe 100 to explain this concept to the individual and provide general guidance regarding the degree of wear that each of strata 131–133 may endure.

The basic concept underlying the outsole wear indicator of the present invention is the ability to distinguish between the various depths of wear in an outsole. In the above discussion, three strata 131–133 were utilized as an example of the manner in which colors may be used to distinguish between various depths of outsole 124. In further embodiments, a greater number of strata may be utilized to provide greater ability to determine the degree to which outsole 124 is worn. For example, six strata that represent the various colors of the spectrum, for example, may be utilized such that the various strata are red, orange, yellow, green, blue, and violet, respectively. In order to achieve the basic concept of the present invention, the various strata may also be replaced by a single layer of material having a broad spectrum of colors that extend through outsole 124. That is, outsole 124 may be formed of a material with a continuously varying color, and the various strata may, therefore, be incorporated into one layer. Each use would, therefore, expose a slightly different color as successive strata of outsole 124 are worn away. As discussed above, any color combination may be used, even colors that are merely different shades of a single color, so long as the different colors may be distinguished from each other.

In combination with strata 131–133, materials with different wear properties may be utilized. Among some individuals that partake in skateboarding activities, the degree to which footwear is worn is a sign of skateboarding prowess. Accordingly, individuals may have an incentive to purposefully wear through specific portions of an outsole. With regard to strata 131–133, for example, the respective materials may be selected to have varying degrees of wear resistance. The material selected for stratum 131 may have relatively low wear resistance, thereby assisting individuals with initial wear in skateboarding shoe 100. Stratum 132 may be formed of a more wear resistant material, thereby limiting the ease with which intermediate degrees of wear may proceed. Finally, stratum 133 may be formed of a material that is highly wear-resistant to inhibit the formation of holes in outsole 124. Suitable materials for strata 131–133 include any of the conventional materials utilized for footwear outsoles, and may include natural or synthetic rubber.

The concepts of the present invention have been disclosed in the preceding discussion with respect to skateboarding shoe 100. The various concepts, however, are applicable to a wide variety of footwear styles. With regard to running shoes, for example, the outsole wear indicator may be utilized to provide an individual with knowledge of when a pair of running shoes should be retired in favor of a new pair. A running shoe conventionally includes a foam midsole that attenuates ground reaction forces and absorbs energy, thereby reducing the stress on the feet and knees of a wearer. Following significant use, the materials that form the midsole of a running shoe may experience compression set, thereby decreasing the effectiveness of the midsole. In general, compression set occurs prior to the time that an outsole wears through. Accordingly, an individual that gauges the life of a pair of running shoes on the life of the outsole may overextend the life of the running shoe. An outsole with colored strata, which are similar to strata 131–133, may be utilized to provide the individual with information concerning the expected life of a running shoe. For example, an individual that runs primarily on a relatively non-abrasive surface that is somewhat compliant, such as a dirt trail, may be instructed to retire a pair of running shoes once stratum 132 is exposed. An individual that runs on a surface that is more abrasive and less compliant, such as concrete, may be instructed to retire a pair of running shoes once stratum 133 is exposed. Accordingly, the outsole wear indicator of the present invention may be utilized to provide an individual with knowledge of the expected life of an article of footwear. Other factors that may affect the life of an article of footwear include the weight of the wearer, the manner in which the footwear is utilized, or the environmental conditions in which the footwear is utilized. The use of various strata, in combination with a system for correlating wear of the strata with factors that relate to midsole life, may be utilized, therefore, to gauge the overall life of an article of footwear.

An outsole wear indicator may also be utilized in dress shoes to indicate when replacement of the sole is necessary. Dress shoe soles are often formed of multiple layers of leather, and may include rubber elements in high-wear areas. As the leather or rubber layers wear, successive changes in color could be used to indicate the degree of wear. Holes that are worn through all layers of leather may damage the shoes internally and limit the degree to which resoling is useful. Accordingly, varied colors of leather may be utilized to indicate that further wear may develop a hole and resoling should be conducted.

Rock climbing shoes would also benefit from the outsole wear indicator of the present invention. Like dress shoes, rock climbing shoes may become damaged internally if wear occurs beyond the rubber outsole. Accordingly, rock climbing shoes may incorporate an outsole with varied colors to indicate when resoling should occur.

Figure 4:
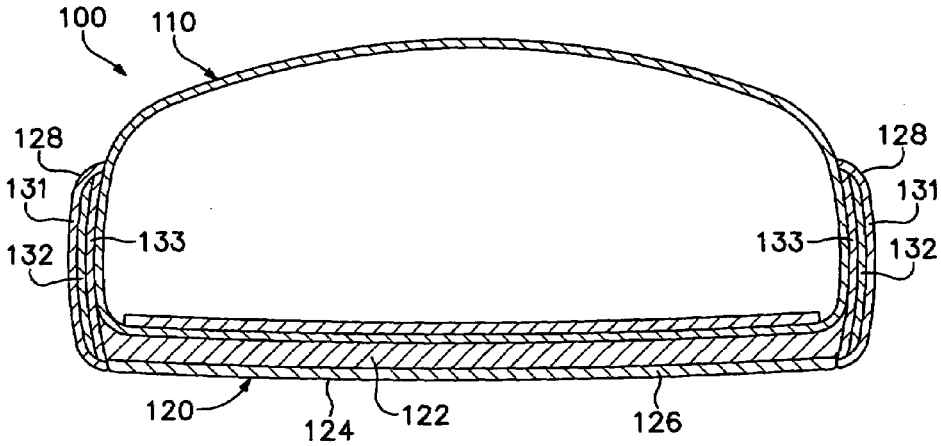
FIG. 4 is a cross-sectional view that corresponds with the view of FIG. 2 and depicts an alternate configuration of the footwear.

The above discussion of skateboarding shoe 100, and the other types of footwear that the outsole wear indicator may be utilized with, includes strata 131–133 in lower portion 126. Some footwear may only include strata 131–133 in areas that are generally visible, such as in toe portion 128. Accordingly, skateboarding shoe 100 may have the configuration depicted in FIG. 4, in which an element of foxing forms toe portion 128 and includes strata 131–133. Outsole 124 also includes lower portion 126, which is depicted as having one layer of outsole material. Accordingly, the various strata 131–133 may be located solely on the sides of skateboarding shoe 100, for example. In other embodiments, and depending upon the intended use for the footwear, the various strata 131–133 may be located in other areas of the footwear, such as the heel region or on the medial and lateral sides of the midfoot region.

The use of outsoles with multi-colored strata may also provide opportunities for generating greater awareness and interest in footwear. With regard to a specific style of footwear having the outsole wear indictor of the present invention, a manufacturer may selectively embed a specially-colored stratum within a relatively small percentage of the outsoles that are manufactured. Individuals that purchase footwear having the specially-colored stratum and subsequently reveal the specially-colored stratum would be eligible for a prize, such as a replacement pair of footwear, for example. Furthermore, a token or other object that is redeemable for a prize may be embedded within the strata. In addition, the manufacturer could request that pictures of unique or distinctive wear patterns be submitted to the manufacturer for publication on a Web site, for example.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. An article of footwear comprising an upper and a sole structure, the upper having a lower surface and sides that extend upward from the lower surface, the sole structure having a midsole formed from a polymer foam material and located adjacent the lower surface of the upper, and the sole structure having an outsole that includes a wear indicator, at least a portion of the wear indicator having a plurality of strata that extend adjacent and parallel to the sides of the upper, the strata including at least a first stratum and a second stratum, the first stratum being located adjacent the second stratum, and the first stratum having a first color and the second stratum having a second color, the first color being visually distinct from the second color.

2. The article of footwear of claim 1, wherein the first color is a different spectral color than the second color.

3. The article of footwear of claim 1, wherein the first color is a different shade of a spectral color than the second color.

4. The article of footwear of claim 1, wherein the first stratum has a different wear-resistance tan the second stratum.

5. The article of footwear of claim 4, wherein the first stratum is formed of different material than the second stratum.

6. The article of footwear of claim 1, wherein the outsole is one of a plurality of outsoles that include a wear indicator with a plurality of strata, the outsole having one of:

an object embedded within the strata; and a specially-colored stratum that is different in color than the strata of the plurality of outsoles;

wherein, the one of the object and the specially-colored stratum may be displayed to redeem a prize.

7. An article of footwear comprising an upper and a sole structure attached to the upper, the sole structure including an outsole formed from rubber materials with a plurality of strata having varying properties, the strata including:

a first stratum located on an exterior of the sole structure, the first stratum having a first color and a first degree of wear-resistance;

a second stratum located adjacent the first stratum and on an interior portion of the sole structure, the second stratum having a second color and a second degree of wear-resistance, the second color being different than the first color, and the second degree of wear-resistance being different than the first degree of wear-resistance; and a third stratum located adjacent the second stratum and opposite the first stratum, the third stratum having a third color and a third degree of wear resistance, the third color being different than the first color and the second color, and the third degree of wear-resistance being different than the first degree of wear-resistance and the second degree of wear-resistance.

8. The article of footwear of claim 7, wherein the strata are formed of different materials.

9. The article of footwear of claim 7, wherein the first degree of wear-resistance is less than the second degree of wear-resistance, and the second degree of wear-resistance is less than the third degree of wear-resistance.

10. The article of footwear of claim 7, wherein the upper includes a lower surface and sides extending upward from the lower surface, and the sole structure includes a midsole formed from a polymer foam material and located adjacent the lower surface, the outsole and the strata being located adjacent the midsole and opposite the lower surface of the upper.

11. The article of footwear of claim 10, wherein the strata extend onto the sides of the upper.

12. The article of footwear of claim 7, wherein the article of footwear is one of a plurality of articles of footwear that include an outsole with a plurality of strata, the article of footwear having one of:

an object embedded within the strata; and a specially-colored stratum that is different in color than the strata of the plurality of outsoles;

wherein, the one of the object and the specially-colored stratum may be displayed to redeem a prize.

13. An article of footwear having an upper and a sole structure attached to the upper, the sole structure comprising an outsole with:

a first portion that extends under the upper; and a second portion that extends onto sides of the upper, the second portion incorporating a wear indicator having a plurality of strata arranged to extend parallel to the upper, the strata including a first stratum and a second stratum, the first stratum being located adjacent the second stratum, and the first stratum having a first color and the second stratum having a second color, the first color being visually distinct from the second color.

14. The article of footwear of claim 13, wherein the first color is a different spectral color than the second color.

15. The article of footwear of claim 13, wherein the first color is a different shade of a spectral color than the second color.

16. The article of footwear of claim 13, wherein a first the stratum has a different wear-resistance than the second the stratum.

17. The article of footwear of claim 13, wherein the first the stratum is formed of different material than the second the stratum.

18. A method of utilizing an article of footwear having an upper and an outsole that includes a wear indicator, the method comprising steps of:

wearing away a portion of a first stratum of the wear indicator to expose a second stratum of the wear indicator, the first stratum being located on an exterior of the sole structure, the second stratum being located adjacent the first stratum and on an interior portion of the sole structure, and the first stratum and the second stratum having different properties, and the first stratum and the second stratum being located adjacent sides of the upper;

wearing away a portion of the second stratum to expose a third stratum of the wear indicator, the third stratum being located adjacent the second stratum and opposite the first stratum, and the second stratum and the third stratum having different properties, the third stratum being located adjacent the sides of the upper.

19. The method recited in claim 18, further including steps of:

wearing away a portion of one of the first stratum or the second stratum to expose one of:

an object embedded within the strata, and a specially-colored stratum that is different in color than strata of a plurality of other outsoles, and redeeming a prize by displaying the one of the object and the specially-colored stratum.

20. An article of footwear having an upper and a sole structure, the sole structure comprising:

a midsole located adjacent the upper; and an outsole that is separate from the midsole and at least partially secured to the midsole, the outsole having a first portion and a separate second portion, the first potion having a first number of strata, and the second portion having a second number of strata, the first number of strata being greater than the second number of strata;

wherein the first portion is a wear indicator and at least two of the first number of strata have different physical properties.

21. The article of footwear recited in claim 20, wherein the first number of strata is one and the second number of strata is at least three.

22. The article of footwear recited in claim 20, wherein the different physical properties are different colors.

23. The article of footwear recited in claim 20, wherein the different physical properties are different degrees of wear-resistance.

24. The article of footwear recited in claim 20, wherein the different physical properties are different colors and different degrees of wear-resistance.

25. The article of footwear recited in claim 20, wherein the first number of strata are each formed from rubber materials.

26. The article of footwear recited in claim 20, wherein the first portion is located in a forefoot region of the footwear, and the second portion is located in at least a heel region of the footwear.

27. The article of footwear recited in claim 26, wherein the first portion is located adjacent sides of the upper.

* * * * *